US005381993A

United States Patent [19]

Eckler

[11] Patent Number: 5,381,993

[45] Date of Patent: Jan. 17, 1995

[54] RIMMED VESSEL SUSPENSION DEVICE

[76] Inventor: Brent L. Eckler, 3085 Creek Dr., Ann Arbor, Mich. 48108

[21] Appl. No.: 183,716

[22] Filed: Jan. 19, 1994

[51] Int. Cl.[6] ..... A47K 1/08

[52] U.S. Cl. ..... 248/312.1; 47/67

[58] Field of Search ..... 248/318, 312.1, 146; 47/67; 211/75, 88

[56] References Cited

U.S. PATENT DOCUMENTS

| | | | |
|---|---|---|---|
| D. 132,368 | 5/1942 | Jorgensen | 47/67 |
| 963,065 | 7/1910 | Pringle | 47/67 X |
| 1,240,908 | 9/1917 | Weis | 248/312.1 X |
| 1,446,036 | 2/1923 | Dodd | 248/312.1 X |
| 2,387,982 | 10/1945 | Demuth | 47/67 X |
| 3,001,753 | 9/1961 | Smith | 248/312.1 X |
| 4,071,976 | 2/1978 | Chernewski | 248/312.1 X |
| 4,147,320 | 4/1979 | Biedebach . | |
| 4,235,407 | 11/1980 | Haas . | |
| 4,385,742 | 5/1983 | Rocquin . | |
| 4,422,610 | 12/1983 | Hunt | 47/67 X |
| 4,440,371 | 4/1984 | Wijsman | 47/67 X |
| 5,074,504 | 12/1991 | Minnick | 47/67 X |

FOREIGN PATENT DOCUMENTS

| | | | |
|---|---|---|---|
| 1424244 | 11/1965 | France | 248/312.1 |
| 2123679 | 2/1984 | United Kingdom | 47/67 |

*Primary Examiner*—J. Franklin Foss
*Attorney, Agent, or Firm*—Krass & Young

[57] ABSTRACT

A device for suspending a vessel from its rim includes a vertically oriented member having at least one notch to receive a section of the rim, the geometry of the notch being characterized in that if a user of the device inserts the rim section and lets go of the vessel it will remain suspended in a desired orientation. Although particularly suited to suspending clay pots of the type used horticulturally, the device is equally suited to any type of rimmed receptacle. A system of holes and pegs may additionally be provided to support the bottom of the vessel. Preferably the notch is formed with a straight blade which creates opposing surfaces that catch on upper/inner and lower/outer points along the rim, respectively.

6 Claims, 2 Drawing Sheets

RIMMED VESSEL SUSPENSION DEVICE

FIELD OF THE INVENTION

The present invention relates generally to apparatus for suspending vessels and, in particular, to a device from which vessels, receptacles, trays and so forth having outer rims such as clay-type pots may be suspended.

BACKGROUND OF THE INVENTION

Numerous design and utility patents exist with respect to the hanging of flower pots, plant baskets, and the like. For the most part, however, such devices include a ring-like structure into which the flower pot or similar article is placed this ring then supporting the pot about the entire lower lip of the rim encircling the mouth of the pot. Examples are set forth in U.S. Pat. Nos. 4,440,371; 4,385,742; 4,235,407; and 4,147,320.

One problem with such devices is that the pot must be placed into, and removed from, an outer ring or rim-engaging clips in order to facilitate common maintenance procedures such as watering. A more convenient hanger would enable the pot to be suspended by only a single section along its rim, ideally being held in place using frictional interfaces which grow more secure as the weight of the vessel and its contents increase. U.S. Pat. No. Des. 288,282 shows one structure capable of suspending a typical clay flower pot by its rim, but the design is somewhat convoluted and appears to be preferably constructed only of a strong formed material such as metal. Based upon the foregoing, the need remains for a simpler, more elegant configuration for hanging vessels and other receptacles, including clay-type flower pots and the like.

SUMMARY OF THE INVENTION

This invention claims non-ornamental features of certain embodiments disclosed in co-pending design patent application Ser. No. 29/017,672.

The present invention provides a simple and elegant device for suspending a rimmed vessel, including a pot of the variety used horticulturally, although any type of vessel or receptacle may potentially be accommodated. An elongated member intended for vertical support includes at least one side notch formed generally upward and into the body of the member, the geometry of the notch being such when a section of the rim of a vessel is received by the notch, the vessel is supported in a desired orientation through a combination of frictional and gravitational forces. In one configuration, the member further includes means to support the bottom of the vessel, preferably using a peg and a plurality of peg-receiving holes formed along the member beneath the notch when the member is vertically supported.

In a preferred embodiment, a straight blade is used to form the notch generally up and into the member, resulting in two opposing surfaces, including a first surface which generally faces down and into the body of the member, and a second surface facing generally up and away from the interior of the member, the vessel being supported in a desired orientation through frictional contact points between the first and second surfaces and points along the top and bottom of the rim of the vessel. In the event that the rim of the vessel includes an upper edge and a lower lip, at least one point of the first surface preferably makes contact with at least one point along the upper edge, and at least one point of the second surface preferably makes contact with at least one point along the lower lip. Depending upon the geometry of the vessel with respect to the notch, the second surface or a ridge associated therewith may further contact a point associated with the outer sidewall of the vessel.

In all embodiments, the notch includes an overhang portion associated with the first surface, this overhang portion extending at least partially into the opening of the suspended vessel. Also in all embodiments, when the rim makes contact with the first surface, a moment is created through gravity which forces at least one point associated with the lower lip or a point along the side of the vessel against the second surface or the side of the member, resulting in the points of friction which hold the vessel in its desired orientation. The friction associated with these points tends to increase with added weight of the vessel and/or its contents, which further stabilizes the holding action of the device, with or without the pegging alternative.

DETAILED DESCRIPTION OF THE EMBODIMENTS

The present invention provides a simple and elegant suspension device using one or more notches to support a vessel such as a clay pot from a localized section of its rim. In the preferred embodiment, the notch is formed into a solid member, as by cutting into wood, though other materials may be used. Alternatively, the notch may be molded into the solid member or formed by the bending of a strip of material, such as metal, but with fewer bends as compared to prior designs.

In the preferred embodiment, a notch formed in accordance with the invention is formed into a piece of wood, for example, using a reciprocating saw, band saw or computer-controlled cutting machine. A commercially available piece of lumber such as a 2×2 is preferably used, though any suitable stock of rectangular, circular or other geometric cross section may alternatively be employed. Once being notched, the member is supported vertically, either by fastening the member against a wall, post or other support surface, or a base or upper hook may be provided to support the member from the floor or hang it from a ceiling, respectively. To further ensure that the pot is held securely, a plurality of holes may be provided to receive a peg at an appropriate distance from the notched area to further support the bottom surface of a vessel having a particular configuration. A single vertical member may further include multiple notches so as to suspend numerous vessels, pots, trays or any other such items, assuming such articles include a rim of suitable geometry to take advantage of the inventive suspension systems.

Figure 1:
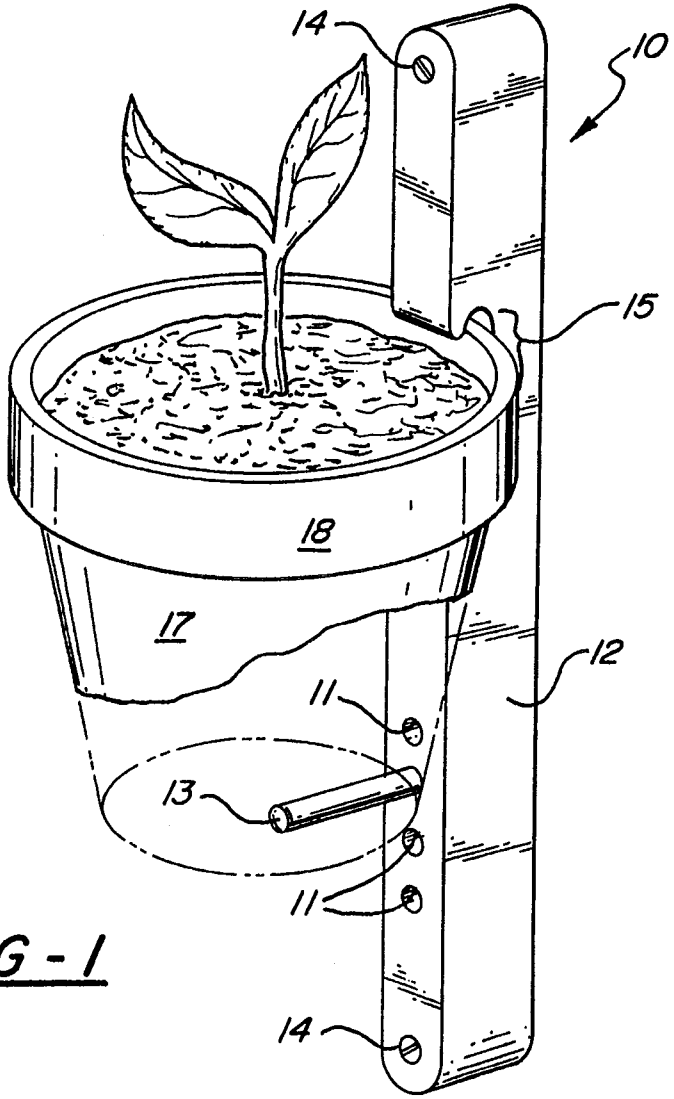
FIG. 1 is an oblique representation of a vertically supported member being notched in accordance with the present invention to suspend a typical clay-type flower pot therefrom, including an optional peg and optional peg-receiving holes intended for bottom support of the pot.

Now making reference to the figures, FIG. 1 shows generally at 10 a vertically disposed member 12, held in place by fasteners 14 against a surface 16. Member 12 includes a notch 15, which will be described in more detail below, having a geometry such that when vessel 17 having rim 18 is properly inserted into notch 15, the vessel is suspended as shown, in its proper orientation, with no other means of support. As previously mentioned, the vessel may take the form of a clay-type of flower pot commonly used for horticultural purposes, or any vessel, tray or similar article having a rim suitable for suspension according to the present invention.

FIG. 1 also shows the optional inclusion of a peg 13 and a plurality of peg-receiving holes formed in member 12, the combination of which may be used for bottom support of the pot or vessel being suspended from notch 15. In most circumstances this pegging system should not be required, but in the even of strong winds, or particularly heavy vessels, such an alternative configuration may be used. Preferably, the holes 11 are simply drilled into the front face of member 12 and peg 13, preferably of wood, inserted into the appropriate hole before or after insertion of rim 18 into notch 15, depending upon the circumstances.

Figure 2B:
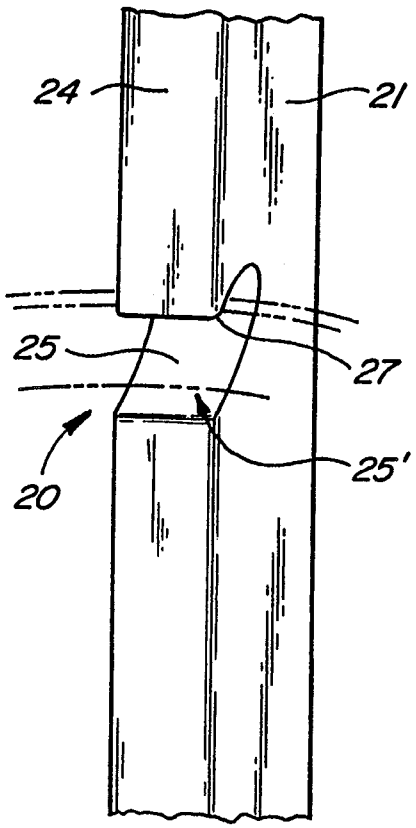
FIG. 2B is an oblique representation of a segment of the member used to show a second surface of the notch and an associated contact point.
Figure 2A:
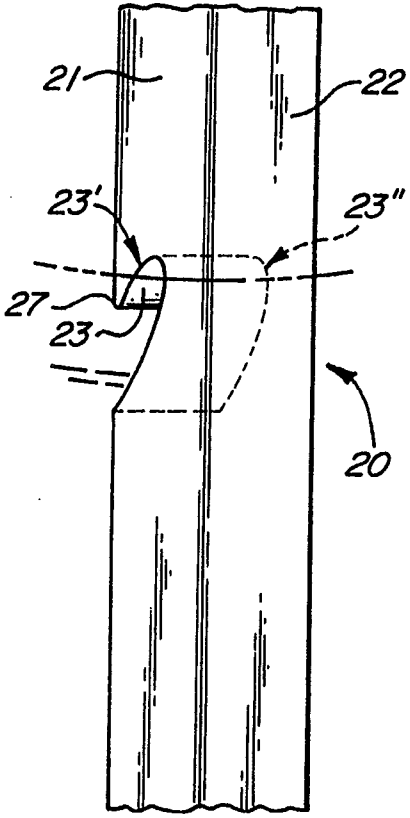
FIG. 2A is an oblique rendering of a section of the vertically supported member used to show a first surface of the notch and contact points associated therewith.

In FIG. 2A there is shown a first view of a section of the member 12 as depicted in FIG. 1, and in FIG. 2B there is shown a different view of that section, these two views being used to show the surfaces and contact points associated with the notch 15 formed in member 12. The view of FIG. 2A is such that the side surface 21 and back surface 22 of member section 20 is viewable, and a vessel or pot is held in the notch, this pot being depicted with broken lines. As seen in FIG. 2A, a first surface 23 is shown associated with the notch, this surface being generally facing downward and into the body of the member 20. As such, with a vessel or pot having a curved rim, generally two contacts are made with surface 23, these being point 23' and point 23". In the event that the rim of the vessel is not round fewer or more contact points may be realized. For instance, in the event of a square type pot, a continuous line of contact may be formed between the upper edge of the rim and surface 23. Alternatively, should the rim have an odd convoluted or corrugated shape, numerous contact points are possible.

In FIG. 2B the front surface 24 and side surface 21 are now viewable on member 20, along with a second surface 25, this second surface being generally oriented upwardly and away from the body of the member 20. As such, with the rim of the vessel or pot again being depicted with broken lines, typically one contact point will be made, that being point 25' as the curved lower lip of the rim touches the surface 25 with the vessel or pot in its proper orientation. Again, however, depending upon the overall configuration of the vessel, other contact points are possible, including contact points between the side wall of the vessel and the front face 24 of the member 20.

Also, when properly oriented, an overhang portion 27, shown in both FIGS. 2A and 2B, is created through the formation of the notch, this overhang portion extending at least partially into the opening or mouth of the vessel when suspended. Although as so far described the notch is generally curved and shown transitioning between the first and second surfaces through a relatively smaller radius, such a banana-like or half-smile type of shape is not necessary according to the present invention. Generally speaking, so long as the notch is formed generally upwardly and into the member creating an overhang portion which extends at least partially into the vessel or pot, resulting in contact points between the first surface associated with this overhang portion, the notch may in fact be of a wide variety of alternative shapes and yet suspend a vessel in a manner anticipated herein.

Figure 3:
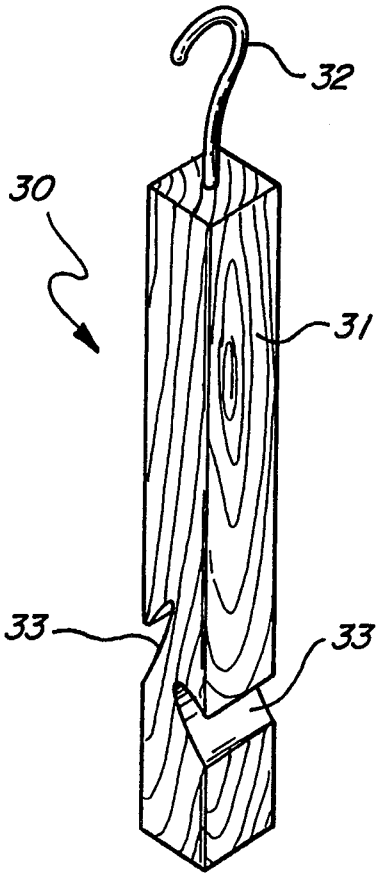
FIG. 3 is an oblique drawing which shows how a vertical member may contain a plurality of notches and a hook for ceiling suspension.

Now turning to FIG. 3, there is shown an alternative embodiment of the present invention at 30 including a member 31, again intended for vertical disposition, in this case through hanging via hook 32. As with other alternative embodiments of the present invention, multiple notches 33 may be formed, in fact, in this case it is most advantageous to form two opposing notches so as to counterbalance one another when occupied, and thus remain properly suspended.

Figure 4:
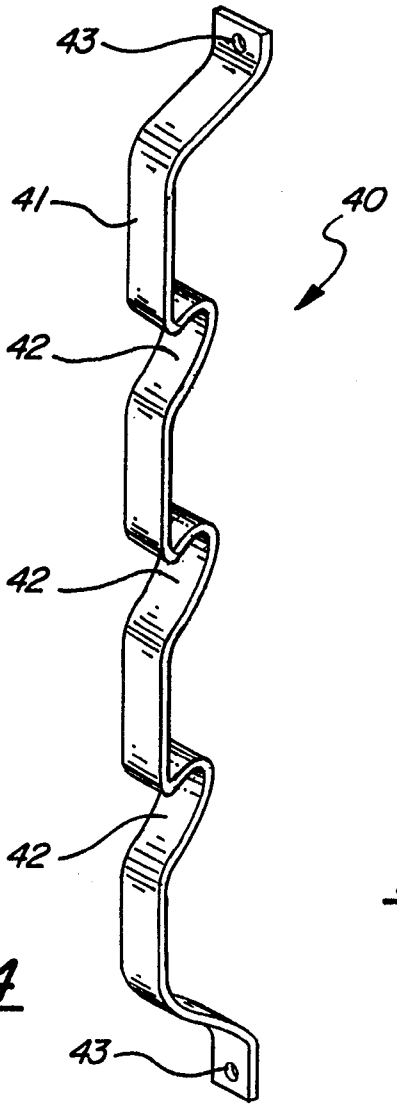
FIG. 4 is an oblique drawing of a strip forming multiple notch shapes through bending.

FIG. 4 shows yet another alternative embodiment at 40, in this case a strip of rigid material such as metal or formed plastic or the like, 41 including one or more shapes 42 mimicking the notch formed with reference to previous embodiments. Holes in tabs 43 may be used, in much the same manner as fasteners 14 in FIG. 1 to properly orient and support strip 41.

Figure 5:
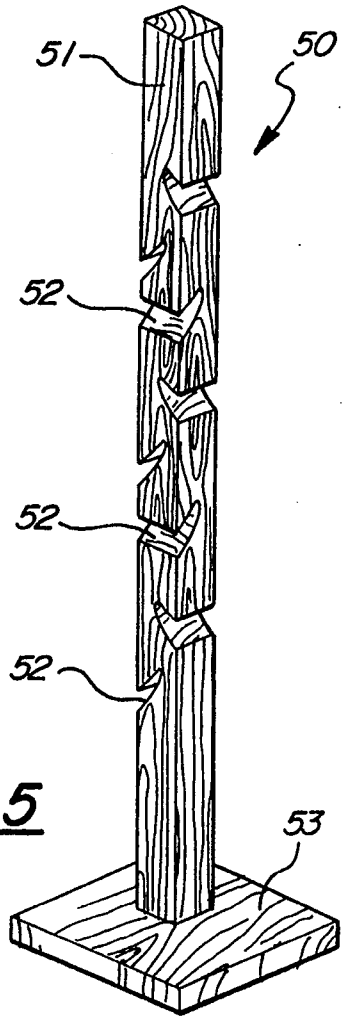
FIG. 5 is an oblique drawing of a longer vertical member including multiple notches on all sides and being affixed to a base so as to be floor standing.

In FIG. 5, depicted at 50 there is shown yet another alternative embodiment of the present invention, in this case an upright member 51 having multiple notches 52 formed in accordance with this invention, upright member 51 in this case being vertically supported through base 53. The alternative shown in FIG. 5 is most advantageously used to create a tree-like effect including multiple suspended vessels as might be found commercially or alternatively, in the home in greenhouses, outdoor porches, and so forth.

Having thus described my invention, I claim:

1. A device for suspending a rimmed vessel, comprising:

an elongated member intended to be supported vertically; and at least one notch formed generally upward and into the body of the elongated member, the notch defining first and second spaced apart surfaces in opposed facing relation, the first surface facing generally downward and toward the body of the member and the second surface facing generally upward and away from the body of the member, the second surface being substantially continuous, whereby a vessel may be supported in a desired orientation with at least one point of the first surface frictionally contacting at least one point along the upper, inner edge of the rim of the vessel, and at least one point of the second surface frictionally contacting a single, localized area on the outside of the vessel, the surfaces of the elongated member and vessel facing one another below the notch being intentionally spaced apart and non-contacting.

2. The device of claim 1, the vessel being a pot of the type used horticulturally.

3. The device of claim 1, including a wooden member.

4. The device of claim 1, further including adjustable means supportive of the bottom of the vessel.

5. The device of claim 4, the adjustable means supportive of the bottom of the vessel including a peg for use in conjunction with a plurality of peg-receiving holes formed along the surface of the elongated member facing the vessel.

6. A device for suspending a receptacle having a sidewall and a mouth with a rim, the rim including an upper edge and a lower lip where the rim meets the sidewall, the device comprising:

an elongated member intended to be positioned vertically;

a notch formed in the member with a straight blade, resulting in two substantially smooth, opposing surfaces, including a first surface which generally faces down and into the interior of the member, and a second surface facing generally up and away from the interior of the member, whereby when a section of the rim is inserted into the notch, at least one point of the upper edge of the rim makes contact with the first surface, creating a moment which forces at least one point associated with the lower lip against the second surface, thereby suspending the receptacle in a desired orientation, solely from the section of the rim and without further side supporting of the vessel.

* * * * *